United States Patent [19]

Harriman

[11] Patent Number: 4,984,788

[45] Date of Patent: Jan. 15, 1991

[54] POOL GAMES APPARATUS

[76] Inventor: Paul W. Harriman, 34 Pinecrest La., Dover, N.H. 03820

[21] Appl. No.: 482,154

[22] Filed: Feb. 20, 1990

[51] Int. Cl.[5] ..... A63D 15/00

[52] U.S. Cl. ..... 273/22; 273/59 R

[58] Field of Search ..... 273/14, 22, 59 R

[56] References Cited

U.S. PATENT DOCUMENTS

| | | | |
|---|---|---|---|
| 294,200 | 2/1884 | Collender | 273/22 |
| 526,554 | 9/1894 | Barnes | 273/14 |
| 854,799 | 5/1907 | Callahan | 273/22 |
| 2,273,239 | 2/1942 | Weicker | 273/22 |
| 3,618,944 | 11/1971 | Myers | 273/14 |
| 3,917,264 | 11/1975 | Davidson et al. | 273/59 R |
| 4,452,450 | 6/1984 | Caylon | 273/22 |
| 4,591,051 | 5/1986 | Lowman | 273/22 |

*Primary Examiner*—Theatrice Brown

*Attorney, Agent, or Firm*—Michael I. Kroll

[57] ABSTRACT

An apparatus for playing pool games is disclosed. The apparatus for playing pool games consists of six additional balls, three minute time glass for timing each player, instruction manual for playing the plurality of pool games that can be found in the instruction manual, and a carry case containing the six balls, the three minute time glass, and the instruction manual.

9 Claims, 1 Drawing Sheet

Fig. 1
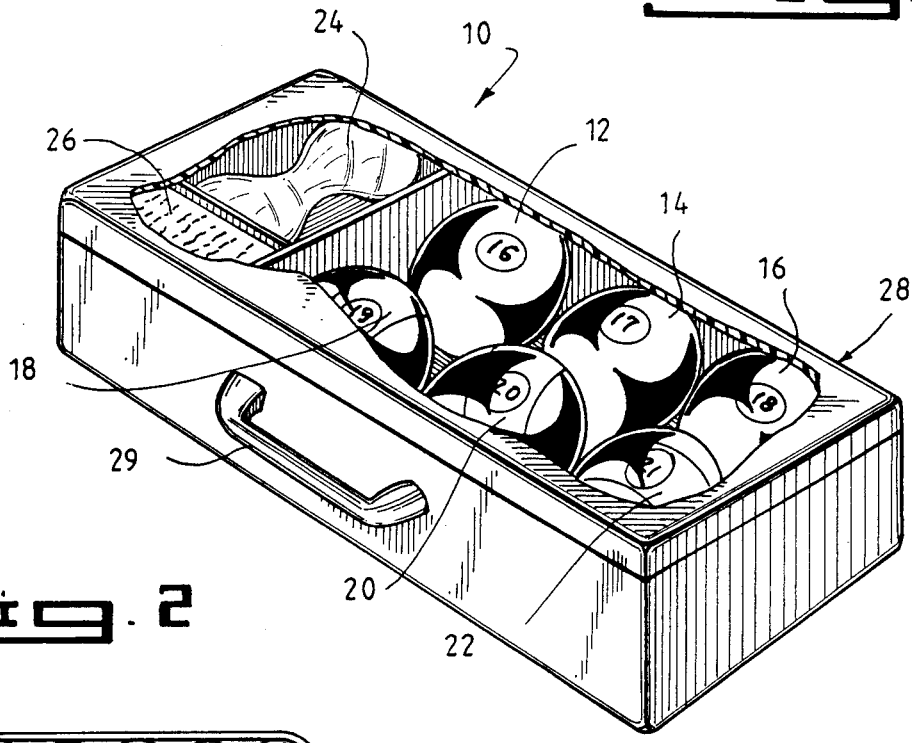
Fig. 2
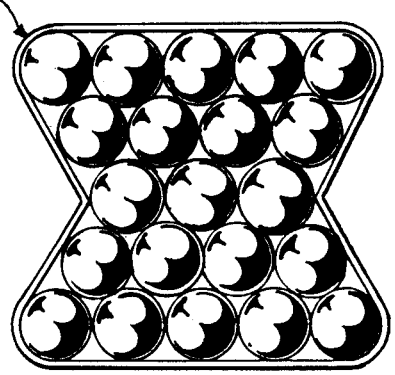
Fig. 3
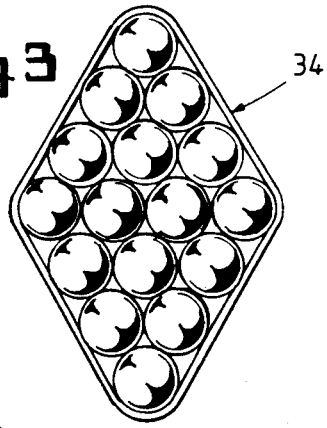
Fig. 4
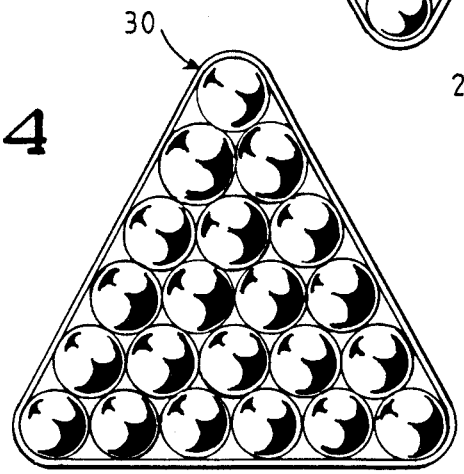
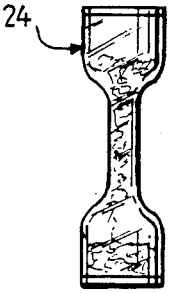
Fig. 1A

POOL GAMES APPARATUS

BACKGROUND OF THE INVENTION

1. Field of the Invention

The present invention relates to the game of pool.

More particularly, the present invention relates to a portable pool game.

3. Description of the Prior Art

Every pool player, whether because of playing a better player or because of playing someone on a run, has unhappily experienced watching the game more than shooting in the game. In a conventional game of pool, players shot until they missed. If a player was good he could end up shooting for a long period of time.

Now through the games of "Super Pool", and "Hourglass Pool", of the present invention, all of the old games, and the new games introduced through the addition of six new balls, can be played using equal shooting time, if desired. The option to play equal shooting time games is still present, if desired.

Numerous innovations for the game of pool have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide pool games that avoid the disadvantages of the prior art.

More particularly, it is an object of the present invention to provide pool games that rejuvenates sales in a stagnated industry, provides new varieties of old games in addition to new games, equalizes shooting time among players of different skill levels, and uses exciting metal flake, flourescent, and psychedelic colors.

The present invention teaches increasing the number of balls used in pool by six, the use of a three minute sandglass to allow the players equal shooting time, the use of metallic flake and flourescent or psychedelic colors rather than the old standard colors, and a variety of new or altered games that may be played.

In keeping with these objects, and with others which will become apparent hereinafter, one feature of the present invention resides, briefly stated, in an apparatus for playing non-conventional pool and including six additional balls, three minute time glass for timing each player, instruction manual for playing the plurality of pool games, and a carry case containing the six balls.

In accordance with another feature of the present invention, it further comprises a rack taken from the group consisting of triangular shaped rack, hour glass shaped rack, and diamond shaped rack.

Another feature of the present invention is that the carry case is made of plastic and includes a handle so that the carry case is simple to carry.

Yet another feature of the present invention is that the six additional balls are colored by a color taken from a group consisting of metal flake, flourescent, and psychedelic so that the six additional balls are glamorized.

Still another feature of the present invention is that the plurality of pool games that can be found in the instruction manual include the new games "Hourglass Pool," and "Super Pool." The standard games "Eight Ball," "Straight Pool," and "Rotation," can now be played with twenty-one balls rather than fifteen, and "Nine Ball" can now be played with sixteen balls rather than nine.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWINGS

FIG. 1 is a perspective view of the present invention with parts broken away;

FIG. 1A is a perspective view of a minute glass of the present invention, used to time the players, if desired;

FIG. 2 is a plan view of a hourglass shaped rack containing twenty one balls;

FIG. 3 is a plan view of a diamond shaped rack containing sixteen balls; and FIG. 4 is a plan view of a triangular shaped rack substantially identical to a conventional rack but containing twenty one balls.

LIST OF REFERENCE NUMERALS UTILIZED IN THE DRAWING

10—pool games of the present invention
12—new ball numbered 16
14—new ball numbered 17
16—new ball numbered 18
18—new ball numbered 19
20—new ball numbered 20
22—new ball numbered 21
24—three minute time glass
26—instruction manual
28—a black plastic carry case containing the new ball numbered 16, the new ball numbered 17, the new ball numbered 18, the new ball numbered 19, the new ball numbered 20, the new ball numbered 21, the three minute time glass, and the instruction manual
29—handle of the black plastic carry case 28
30—triangular shaped rake for use in the pool games 10
32—hour glass shaped rack for use in the pool games 10
34—diamond shaped rack for use in the pool games 10

DETAILED DESCRIPTION OF THE PREFERRED EMBODIMENT

Referring now to the FIGURES, the equipment used to play the pool games of the present invention is shown generally at 10 and includes six balls 12, 14, 16, 18, 20, and 22, (sixteen through twenty one), a three minute time glass 24, an instruction manual 26, and black plastic carry case with a handle 29.

Also available are accessories, such as, a triangular rack 30 for twenty one balls, an hour glass shaped rack 32, and a diamond shaped rack 34 for sixteen balls.

One of the games of the present invention is "Super Pool". As "Super Pool" catches on and the new balls 12, 14, 16, 18, 20, and 22 glamorize the pool game of the present invention, requests for metallic flake colors for the conventional first fifteen balls will create a retrofit or a replacement.

Colored lighting in various colors to reflect the metallic flake balls 12, 14, 16, 18, 20, and 22 help glamorize the entire pool game 10 for the forward thinking pool parlors.

By use of the present invention, the game of pool can now be glamorized. With the six new balls 12, 14, 16, 18, 20, and 22 containing metallic flake colors, the pool table will reflect metallic flake colors and creates a glamorized illusion.

Another one of the games of the present invention is "Hourglass Pool".

Many new pool games can be played with "Super Pool" and "Hourglass Pool" of the present invention, such as:

EIGHT BALL: The winning player has to sink ten balls, either the solid colored balls or the striped balls, and then the eight ball. All other conventional eight ball parameters still apply.

STRAIGHT POOL: All twenty-one balls are racked in either the triangular shaped rack 30 or the hourglass shaped rack 32. All other conventional straight pool parameters still apply.

ROTATION: All twenty-one balls are racked. All other conventional parameters still apply.

NINE BALL: Rack sixteen balls in the diamond shaped rack 34. Money balls must be designated and agreed upon before the game starts. All other conventional nine ball parameters still apply.

The game of "Hourglass Pool" may be played with two or more players each shooting in rotation. The balls are racked in the shape of an hourglass by using the hourglass shaped rack 32. When ready, the player turns the three minute glass 24 over and quickly breaks the rack. He continues shooting, whether shots are missed or not, until the time is up, which is indicated by the three minute glass. The number of balls sunk is recorded. The opponent then turns the minute glass 24 over and begins shooting. If the rack is finished while the player is still playing his turn, he must rack the balls while the sand is still flowing, and then continue shooting without a time out.

If the player's shooting time is nearly up, as shown on the remaining sand in the three minute glass 24, the player may elect to let the time expire and force his opponent to rack the balls at the beginning of his sand time.

Four variations of the pool game "Hourglass Pool" of the present invention include:

First, the game may be considered complete after one, two, or as many turns of the minute glass 24 is agreed upon. Second, the balls are shot in rotation beginning with the on ball and ending with the twenty one ball. All parameters of conventional rotation still apply. Third, the balls may be shot in any order as in straight pool. All parameters of conventional straight pool still apply. Fourth, "Hourglass Pool" may be played using the triangular shaped rack 30 having twenty one balls, or the diamond shaped rack 34 having sixteen balls and also may use twenty-one, sixteen, fifteen, or nine balls.

"War" is another game of the present invention. may be played with two or more players shooting in rotation. The balls are racked in the "Hourglass" or the "Super Pool" shape. One player or team has all of the solid balls except the 8-ball. The other player or team has all the striped balls. The object of the play is to sink all of the opponent's balls. If a player sinks an opponent's ball he continues shooting until he misses, except when Chaos reigns.

The 8-Ball is called Alien Force and may be used by either side twice during a game, at a turn of the player's choice, instead of using the cue ball. As long as the player does not miss during that turn, he may use either the cue ball or the 8-ball, as the cue ball. A player may prevent his opponent from using Alien Force by sinking the 8-ball during his turn. However, any time Alien Force goes into a pocket, either by accident or on purpose, Chaos Reigns for the rest of the game. Once Chaos reigns any of the remaining balls, as well as the cue ball, may be used as the cue ball. But, whether the player sinks an opponent's ball or not, the opponent shoots next. The cue ball gains special powers when Chaos Reign. If a player succeeds in sinking the cue ball with one of his balls, the shot must be called, he can replace two of his balls on the table, one behind the other on the "spot". However, on the other hand, if the cue ball is sunk accidentally by a player, two of his balls must be removed from the table. If only two of his balls remain, he loses the game.

The present invention teaches a number of timed games along with respective equipment, such as the triangular rack for "Twenty-one Pool", the hourglass shaped rack for "Hourglass Pool" and the diamond shaped rack for "Sixteen ball". The three minute glass 24 is provided for timed shooting.

The racks are made of plastic, but they are not limited to it. The new shapes and dimensions of the racks are used in "Super Pool", "Hourglass Pool", and "Sixteen Ball". A gift starter pack includes the six balls 12, 14, 16, 18, 20, and 22, the instruction manual 26, and the three minute glass 24.

The instruction manual 26 teaches "Super Pool," "Hourglass Pool," and "Sixteen Ball" and explains the use of the three minute glass 24.

The present invention includes the addition of six more balls 12, 14, 16, 18, 20, and 22 to the standard fifteen balls used in conventional pool or billiards, a three minute sandglass 24, and an instruction manual 26. Additionally, new variations of the standard games and the completely new games, add variety to the games that may be played.

The six additional balls 12, 14, 16, 18, 20, and 22, the three minute sandglass 24, and the instruction manual 26 are housed in an easy to carry black plastic case 28 with a handle 29 comprises the basic new unit of the present invention.

It will be understood that each of the elements described above, or two or more together, may also find a useful application in other type of constructions differing from the type described above.

While the invention has been illustrated and described as embodied in a pool game, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. Apparatus for playing pool games, comprising:

(a) six original balls to be used by each player of a plurality of players to play a plurality of pool games;

(b) three minute time glass for timing each said player;

(c) instruction manual for playing said plurality of pool games that can be found in said instruction manual; and (d) a carry case containing said six balls, said three minute time glass, and said instruction manual.

2. An apparatus as defined in claim 1; further comprising a triangular shaped rack.

3. An apparatus as defined in claim 2, wherein said carry case is made of plastic and includes a handle so that said carry case is simple to carry.

4. An apparatus as defined in claim 3, wherein six additional balls are colored by metal flake so that said six additional balls are glamorized.

5. An apparatus as defined in claim 4, wherein said plurality of pool games that can be found in said instruction manual include "Hourglass Pool," "Super Pool," "Eight Ball," "Straight Pool," "Rotation," and "Nine Ball".

6. An apparatus as defined in claim 1; further comprising an hour glass shaped rack.

7. An apparatus as defined in claim 1; further comprising a diamond shaped rack.

8. An apparatus as defined in claim 7, wherein six additional balls are colored by fluorescent.

9. An apparatus as defined in claim 8, wherein six additional balls are colored by psychedelic.

* * * * *